United States Patent [19]

Shillingford

[11] 3,952,520

[45] Apr. 27, 1976

[54] SHORELINE RETAINING WALL

[76] Inventor: Thomas H. Shillingford, 26 Underhill Drive, Suite 709, Don Mills, Ontario, Canada

[22] Filed: Apr. 28, 1975

[21] Appl. No.: 572,261

Related U.S. Application Data

[63] Continuation-in-part of Ser. No. 453,693, March 22, 1974, abandoned.

[52] U.S. Cl. ..... 61/4; 61/49

[51] Int. Cl.[2] ..... E02B 3/04

[58] Field of Search ..... 61/4, 49, 3, 39, 2

[56] References Cited

UNITED STATES PATENTS

| | | | |
|---|---|---|---|
| 905,596 | 12/1908 | Smith | 61/4 |

FOREIGN PATENTS OR APPLICATIONS

| | | | |
|---|---|---|---|
| 915,057 | 1/1963 | United Kingdom | 61/49 |
| 1,189,542 | 10/1959 | France | 61/49 |
| 1,326,578 | 4/1963 | France | 61/49 |

*Primary Examiner*—Jacob Shapiro

[57] ABSTRACT

A retaining wall for use in stabilizing shoreline erosion. An upright wall portion, standing on a footing, carries a pattern of recesses in its front face extending the length and height of the wall portion. Preferably the recesses are rectangular in lateral cross-section and are located in the front face of the wall portion in a staggered grid pattern.

8 Claims, 2 Drawing Figures

SHORELINE RETAINING WALL

This application is a continuation-in-part of U.S. patent application Ser. No. 453,693 filed Mar. 22, 1974 in the name of Thomas H. Shillingford and now abandoned.

This invention relates to a retaining wall of the type used to inhibit or to stabilize shoreline erosion.

The undermining of shorelines is a constant problem in many beach localities. Retaining wall constructed to prevent such erosion are themselves often undermined.

It is an object of the present invention to provide an improved retaining wall which will aid in building a sand beach to buttress the wall.

In its broadest aspect the invention resides in a retaining wall having a footing and an upright wall portion with a plurality of recesses extending in a pattern across the front face of the wall.

An example embodiment of the invention is shown in the accompanying drawings in which.

Figure 1:
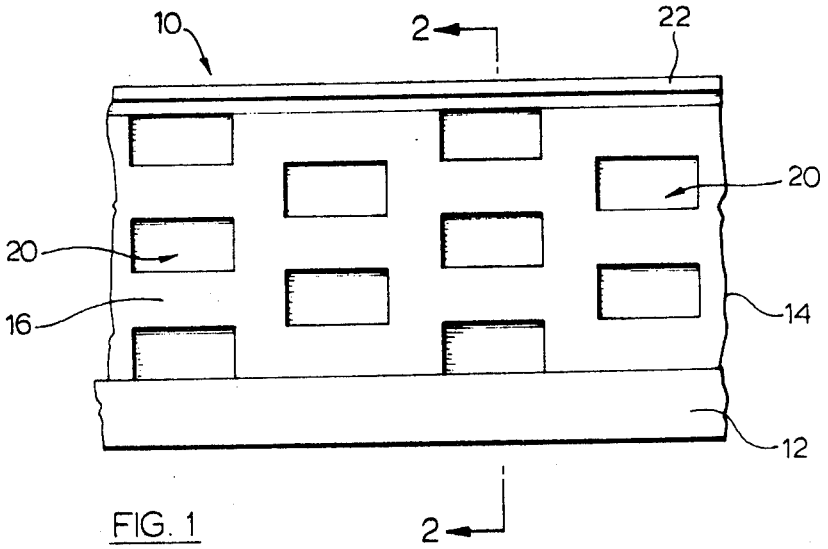
FIG. 1 is a front view in elevation of a retaining wall.

The example embodiment shown in the drawings consists of a retaining wall 10 having a footing 12 and an upright wall portion 14 of substantial thickness. Wall portion 14 has a substantially vertical front or shoreward face 16 and a rear or retaining face 18 which may be parallel to the front face. A plurality of blind recesses or cavities 20, spaced one from another, are located in front face 16 of wall portion 14 and extend in a pattern the length and height of the front face of the wall. Recesses 20 extend into wall portion 14 substantially normal to front face 16, i.e. substantially horizontal.

Preferably recesses 20 are substantially rectangular in lateral cross-section i.e. parallel to front face 16 of wall portion 14 as seen in the drawings. Although the pattern of recesses 20 in front face 16 of wall 10 may be random it is preferably a grid pattern with adjacent vertical rows of recesses being staggered as seen in FIG. 1. The preferred size of recesses 20 depends in part on the height of wall portion 14; for a wall portion less than 6 feet in height recesses 20 are preferably about 1 foot, 6 inches high and about 2 feet wide in lateral cross-section while for a wall portion more than 6 feet in height the recesses are preferably about 2 feet high and about 2 feet wide in lateral cross-section. Recesses 20 are preferably as deep as they are wide, i.e. 2 feet in depth. In any event recesses 20 are not less than 1 foot, 6 inches in either height or width and not more than 2 feet in depth.

To give adequate strength to wall 10, the thickness of wall portion 14 between faces 16 and 18 is preferably one and one-half times the depth of recesses 20, i.e. 3 feet in thickness. For staggered recesses 20 as seen in FIG. 1 a preferred horizontal distance along front face 16 of wall 10 between the edges of adjacent recesses, and also a preferred vertical distance between adjacent recesses, would be 1 foot.

Figure 2:
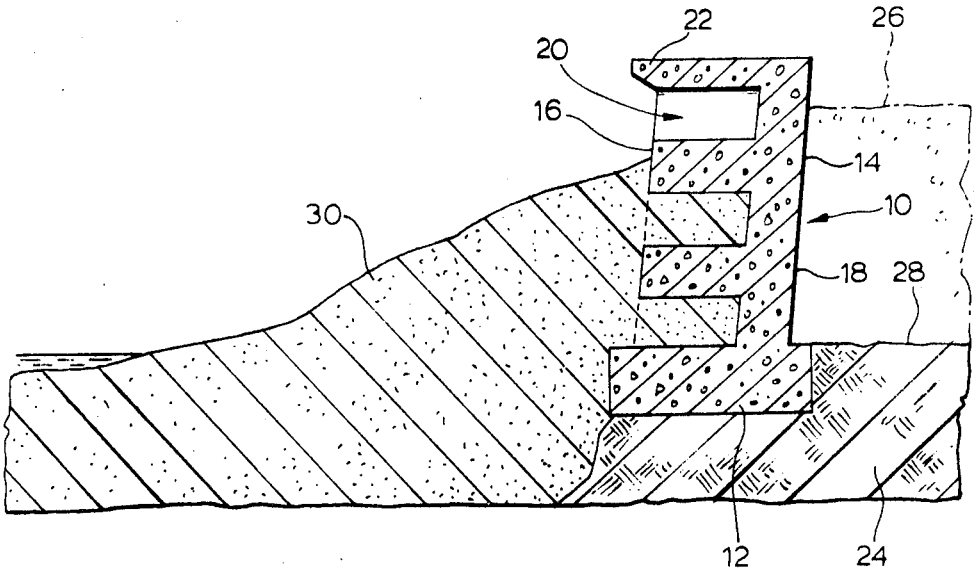
FIG. 2 is a cross-sectional view taken along line 2—2 of FIG. 1 and showing the wall in position and forming a beach.

As seen in FIG. 2, wall portion 14 of wall 10 is preferably slightly inclined rearwardly on footing 12 to provide added strength as a retaining wall and may carry a forwardly projecting cornice 22 along the upper edge of front face 14.

In use, wall 10 is preferably located along the shoreline approximately at a distance from the waterline reached by the average wave, depending upon the contour of the beach to be formed by the wall. Footing 12 is rested on firm ground 24 as seen in FIG. 2 and overburden 26 is deposited above ground level 28. In areas of frost, footing 12 must rest below the frost line of ground 24. If desired, wall 10 may be precast in longitudinal sections and the sections may be placed side by side like masonry blocks to form the wall. It is preferable to bury wall 10 initially to cover at least the bottom row of recesses 20 as a safety factor to prevent footing 12 from being undercut.

When wall 10 is in place, waves of water travelling up the beach and carrying entrained sand will impinge on the wall. Irrespective of the direction of travel of the waves, which may be either normal to the wall or, more usually, at an angle thereto, the water will enter recesses 20. The width of recesses 20 is preferably two feet to ensure that when waves are running diagonally along the beach the water will still be trapped in the recesses. Because the recesses are shallow and blind, the kinetic energy of the water will be dissipated and at the same time air trapped in the recesses will be entrained in the water. As the dead water falls back from recesses 20 it will drop in front of face 16 of wall 10, carrying the entrained air and sand with it to form a sieve-like bed of samd through which the water will percolate. In this manner a beach 30 is built against wall 10 as seen in FIG. 2, the beach being consolidated as the entrained air escapes over a period of time.

Beach 30 is self-regulated by wall 10 because as soon as the top row of recesses 30 is covered the action of the waves will scour the upper layer of sand re-expose the top row of recesses, whereupon the dampening effect of the recesses on the waves will rebuild the sand. This action of covering and re-exposing the top row of recesses 20 will be endlessly repetitive.

I claim:

1. A retaining wall for use in stabilizing shoreline erosion, comprising a footing and an upright wall portion, the front face of the wall portion having a plurality of recesses spaced apart one from another to form a pattern extending substantially the length and the height of the wall, each recess being horizontally oriented and being uniform in cross-section throughout the depth thereof, the lateral dimension of the recess being not less than 18 inches in any direction, the depth of each recess being not greater than the width thereof, and not greater than 2 feet, the wall being located along the shoreline at a distance from the waterline reached by an average wave.

2. A retaining wall as claimed in claim 1 in which the recesses are each substantially rectangular in lateral cross-section.

3. A retaining wall as claimed in claim 1 in which the recesses are located in the front face of the wall portion in grid pattern.

4. A retaining wall as claimed in claim 3 in which adjacent vertical rows of recesses are staggered.

5. A retaining wall as claimed in claim 2 in which the height of the wall portion is greater than 6 feet and the recesses are each about 2 feet square in lateral cross-section.

6. A retaining wall as claimed in claim 2 in which the height of the wall portion is less than 6 feet and the recesses are each about 2 feet wide and about 18 inches high in vertical cross-section.

7. A retaining wall as claimed in claim 1 in which the wall is concrete precast in longitudinal sections.

8. A retaining wall as claimed in claim 1 in which the depth of each recess in substantially equal to its width.

* * * * *